US005902522A

United States Patent [19]

Seawell et al.

[11] Patent Number: 5,902,522

[45] **Date of Patent: *May 11, 1999**

[54] RIGID COOLING TOWER AND METHOD OF CONSTRUCTING A COOLING TOWER

[75] Inventors: Jesse Q. Seawell; Toby L. Daley, both of Fort Worth; Charles J. Bardo, Lake Kiowa; James A. Bland, Rhome; Gregory S. Mailen, Waxahachie, all of Tex.

[73] Assignee: Baltimore Aircoil Company, Inc., Jessup, Md.

[ * ] Notice: This patent issued on a continued prosecution application filed under 37 CFR 1.53(d), and is subject to the twenty year patent term provisions of 35 U.S.C. 154(a)(2).

[21] Appl. No.: 08/711,261

[22] Filed: Sep. 9, 1996

[51] Int. Cl.[6] ..... B01F 3/04

[52] U.S. Cl. ..... 261/111; 52/298; 52/299; 52/656.9; 52/712; 261/DIG. 11

[58] Field of Search ..... 261/DIG. 11, 111; 52/298, 299, 712, 656.9

[56] References Cited

U.S. PATENT DOCUMENTS

| | | | |
|---|---|---|---|
| 225,683 | 3/1880 | Brady | 52/298 |
| 2,517,332 | 8/1950 | Mitchell et al. | 52/298 |
| 2,842,955 | 7/1958 | Pedersen | 52/712 |
| 3,267,627 | 8/1966 | Hammitt | 52/298 |
| 4,048,776 | 9/1977 | Sato | 52/298 |

(List continued on next page.)

OTHER PUBLICATIONS

BAC–Pritchard, Inc.—Series 4009 Steel Cooling Towers Brochure, Jul. 1989.

Unilite Pultruded Composite Structure Cooling Tower Brochure, Dec. 1994.

Ceramic Cooling Tower Company—Ultralite 100 Cooling Towers Brochure, 1992.

Ceramic Cooling Tower—Permalite 200 Brochure, Aug. 1989.

(List continued on next page.)

*Primary Examiner*—Richard L. Chiesa
*Attorney, Agent, or Firm*—Edward J. Brosius; F. S. Gregorczyk; Stephen J. Manich

[57] ABSTRACT

A cooling tower is disclosed that is resistant to lateral displacement while minimizing the number and type of parts, and while limiting the amount of horizontal bracing. The cooling tower has a fiber reinforced material skeletal frame. Moment-transferring connections are provided in the connections between the elements of the skeletal frame and between the skeletal frame and the base on which it sits. Further cost savings may be realized by using separable parts made of wood instead of fiber reinforced material. The moment-transferring connections between the frame members are made by bonding the joined elements to a mounting plate. The moment-transferring connections between the frame and the base are made by bonding the frame members and the base to footings. A method of constructing such a cooling tower is also disclosed. Diagonal bracing may be provided at preselected joints.

10 Claims, 11 Drawing Sheets

U.S. PATENT DOCUMENTS

| | | | |
|---|---|---|---|
| 4,416,836 | 11/1983 | Sinek | 261/DIG. 11 |
| 4,422,983 | 12/1983 | Bardo et al. | 261/24 |
| 4,530,194 | 7/1985 | Linton et al. | 52/712 |
| 4,543,218 | 9/1985 | Bardo et al. | 261/24 |
| 4,637,903 | 1/1987 | Bardo et al. | 261/24 |
| 4,875,808 | 10/1989 | Kellison | 52/298 |
| 4,913,710 | 4/1990 | Reverdv | 55/440 X |
| 4,976,895 | 12/1990 | Bardo | 261/108 |
| 5,028,357 | 7/1991 | Bardo | 261/111 |
| 5,155,961 | 10/1992 | Bardo | 52/646 |
| 5,184,440 | 2/1993 | Felix et al. | 52/656.9 |
| 5,236,625 | 8/1993 | Bardo et al. | 261/24 |
| 5,357,729 | 10/1994 | Schutze | 52/653.2 |
| 5,568,909 | 10/1996 | Timko | 52/298 |
| 5,577,353 | 11/1996 | Simpson | 52/712 |
| 5,585,047 | 12/1996 | Mortensen et al. | 261/DIG. 11 |

OTHER PUBLICATIONS

Ceramic Cooling Tower—Permalite 600 Brochure, Oct. 1989.

Ceramic Cooling Tower—Concrete Structure Cooling Towers Brochure, Oct. 1989.

Ceramic Cooling Tower—Ultralite 600XL & 1000XL Brochure, Feb. 1994.

Baltimore Aircoil Company Series 4006 Field Erected Industrial Cooling Towers Brochure, May 1994.

Baltimore Aircoil Company Industrial Modular Cooling Towers Brochure, Sep. 1993.

Ceramic Cooling Tower Company Unilite L–Series Cooling Towers Brochure, Nov. 1994.

BAC Pritchard, Inc.—Series 4000 Wood Structure Crossflow Cooling Tower, Nov. 1982.

BAC Pritchard, Inc. Series 4008 Wood Cooling Tower, Jul. 1989.

BAC–Pritchard, Inc. Series 7000 Wood Structure Counterflow Cooling Tower, Jul. 1989.

BAC–Pritchard, Inc. Series 7000 Field–Erected Counterflow Cooling Tower, Aug. 1980.

Ceramic Cooling Tower Company—Custom Concrete Towers, Permalite Fiberglass Towers, Ultralite Fiberglass Towers & Unilite Fiberglass Towers Brochure, Aug. 1991.

Wood Cooling Tower Drawing, Undated.

RIGID COOLING TOWER AND METHOD OF CONSTRUCTING A COOLING TOWER

FIELD OF THE INVENTION

The present invention relates to cooling towers, and more particularly, to field erected cooling towers designed to withstand lateral forces of wind, earthquakes and the like.

BACKGROUND OF THE INVENTION

Cooling towers are used to cool liquid by contact with air. Many cooling towers are of the counter-flow type, in which the warm liquid is allowed to flow downwardly through the tower and a counter current flow of air is drawn by various means upward through the falling liquid to cool the liquid. Other designs utilize a cross-flow of air, and forced air systems. A common application for liquid cooling towers is for cooling water to dissipate waste heat in electrical generating and process plants and industrial and institutional air-conditioning systems.

Most cooling towers include a tower structure. This structural assembly is provided to support dead and live loads, including air moving equipment such as a fan, motor, gearbox, drive shaft or coupling, liquid distribution equipment such as distribution headers and spray nozzles and heat transfer surface media such as a fill assembly. The fill assembly material generally has spaces through which the liquid flows downwardly and the air flows upwardly to provide heat and mass transfer between the liquid and the air. One well-known type of fill material used by Ceramic Cooling Towers of Fort Worth, Tex. consists of stacked layers of open-celled clay tiles. This fill material can weigh 60,000 to 70,000 pounds for a conventional size air conditioning cooling tower. Structural parts of a cooling tower must not only support the weight of the fill material but must also resist wind forces or loads and should be designed to withstand earthquake loads.

Due to the corrosive nature of the great volumes of air and water drawn through such cooling towers, it has been the past practice to either assemble such cooling towers of stainless steel or galvanized and coated metal, or for larger field assembled towers, to construct such cooling towers of wood, which is chemically treated under pressure, or concrete at least for the structural parts of the tower.

Metal parts of cooling towers can be corroded by the local atmosphere or the liquid that is being cooled, depending on the actual metal used and the coating material used to protect the metal. Further, such metal towers are usually limited in size and are also somewhat expensive, especially in very large applications such as to cool water from an electric power generating station condenser.

Concrete is very durable, but towers made of concrete are expensive and heavy. Many cooling towers are located on roofs of buildings, and the weight of a concrete cooling tower can present building design problems.

Plastic parts are resistant to corrosion, but plastic parts ordinarily would not provide enough strength to support the fill material and the weight of the tower itself.

Wood has been used for the structural parts of cooling towers, but also has its disadvantages. Wood towers may require expensive fire protection systems. The wood may decay under the constant exposure not only to the environment, but also to the hot water being cooled in the tower. Wood that has been chemically treated to increase the useful life may have environmental disadvantages: the chemical treatment may leach from the wood into the water being cooled. Fiber reinforced plastic has been used as a successful design alternative to wood and metal.

To withstand expected lateral wind and seismic loads, support towers have generally been of two types: shear wall frame structures and laterally braced frame structures. Shear wall frame structures are generally of fiber reinforced plastic or concrete construction, and have a network of interconnected columns and beams. Shear walls are used to provide lateral resistance to wind and earthquake loads. In laterally braced framing structures, the cooling towers are generally made of wood or fiber reinforced plastic beams and columns, framed conventionally for dead load support; diagonal braces are used to resist lateral loads. The joints where the beams and columns meet are designed to allow for rotation between the structural elements. The joints do not provide lateral resistance to loading or racking of the structure.

Prior art solutions using fiber reinforced plastic include those shown in U.S. Pat. No. 5,236,625 to Bardo et al. (1993) and U.S. Pat. No. 5,028,357 (1991) to Bardo. Both patents disclose structures suitable for cooling towers, but a need remains for a mid-priced structure suitable for use as a cooling tower.

Thus, whitle prior fiber reinforced plastic tower structures have solved many of the problems associated with wood and metal cooling tower structures, many of the solutions to the problem of resistance to lateral loading have increased the costs of these units. Both the shear wall and laterally braced frames can be labor intensive to build, since there are many parts and many connections to be made. There are a large number of key structural elements, with more complex manufacturing and inventorying of parts, increasing the complexity of construction, and therefore the costs. And while the increased costs can be justified in many instances, a need remains for a lower cost cooling tower structure, and for lower cost cooling tower structures that meet less exacting design criteria where the prior structures go beyond the need.

In fiber reinforced plastic frame structures, one difficulty with the joint between the columns and beams has been that when made with conventional bolts or screws, the beams and columns can rotate with respect to each other. If tighter connections were attempted to be made with conventional bolts or screws, to limit rotation and provide lateral stability without adding diagonal bracing, the fiber reinforced plastic material could be damaged, and the problem worsened as the connecting members degrade the fiber reinforced plastic and enlarge the holes in which they are received.

SUMMARY OF THE INVENTION

The present invention addresses the need to provide field erected cooling towers that are easy to design, manufacture and construct. It also addresses the need for field erected cooling towers that are less expensive to manufacture and simpler to construct than conventional cooling towers. It provides a mid-level cooling tower structure that meets the need for a cooling tower that fulfills less exacting design criteria to lower the cost of the unit. It fulfills the need for lateral stability to withstand anticipated wind and earthquake loads while reducing or eliminating the need for traditional diagonal bracing and while eliminating shear walls. It also allows for an increased span for beams while meeting design criteria for creep and service life, without increased diagonal bracing, while also providing design flexibility for increased service life and reduced creep in beams in cooling towers.

In one aspect, the present invention meets these objectives by providing a rigid frame structure comprising a pair of vertical columns and a horizontal beam extending between the columns, all made of a material containing reinforcing fibers. The vertical columns and the horizontal beam have co-planar surfaces at their junctures. A mounting plate is at a juncture of the horizontal beam and the vertical columns. The mounting plate has one side bonded to the co-planar surfaces of the horizontal beam and the vertical column at the juncture to define a moment-transferring joint between the horizontal beam and the vertical column.

In another aspect the present invention provides a cooling tower comprising a plurality of vertical columns made of a material containing reinforcing fibers. There are a plurality of first level horizontal beams made of a material containing reinforcing fibers. Each first level horizontal beam extends between a pair of columns at a first vertical level. There are also a plurality of second level horizontal beams made of a material containing reinforcing fibers. Each second level horizontal beam extends between a pair of columns at a second vertical level. The vertical columns and the first level horizontal beams have co-planar surfaces at the junctures of the first level horizontal beams and the vertical columns. The vertical columns and the second level horizontal beams also have co-planar surfaces at the junctures of the second level horizontal beams and the vertical columns. There is a water distribution system for distributing water to be cooled within the cooling tower. The water distribution system is at the second vertical level. There is fill material through which air and water from the water distribution system may pass. The fill material is at the first vertical level. There is a fan for causing air to move through the fill material for cooling water in the fill material. Mounting plates are provided at a plurality of the junctions of the vertical columns and the first level horizontal beams, each mounting plate being disposed at one junction and having a mounting surface bonded to the co-planar surfaces of the first level horizontal beams and the vertical columns to define a moment-transferring joint at the juncture. Mounting plates are also provided at a plurality of the junctions of the vertical columns and the second level horizontal beams, each mounting plate being disposed at one junction and having a mounting surface bonded to the co-planar surfaces of the second level horizontal beams and the vertical columns to define a moment-transferring joint at the juncture.

In yet another aspect the present invention provides a structure having a skeleton made of material containing reinforcing fibers. The structure includes a base and a plurality of vertical columns made of a material containing reinforcing fibers. The columns are spaced apart and have bottom ends. There are a plurality of horizontal beams made of a material containing reinforcing fibers, each horizontal beam extending between and connected to a pair of adjacent columns. Footings are provided for mounting the vertical columns on the base. In this embodiment, each footing is secured to the base and bonded to the bottom ends of the vertical columns.

In yet another aspect the present invention provides a cooling tower comprising a skeletal support frame defining an interior volume. The skeletal frame includes a plurality of vertical columns made of a material containing reinforcing fibers and a plurality of horizontal beams made of a material containing reinforcing fibers. Each beam is connected at its ends to a pair of the vertical columns. The cooling tower also includes a water distribution system to distribute water within the interior volume defined by the skeletal support frame and fill material within the interior volume defined by said skeletal support frame for receiving water from the water distribution system and through which the water may travel. The cooling tower also includes means for causing air to move through the fill material to cool the water received in the fill material from the water distribution system and means for collecting cooled water from the fill material. The cooling tower also includes a separable member selected from the group consisting of a deck on top of the cooling tower, lintels under the deck, a ladder on the exterior of the cooling tower, and a guard rail on top of the cooling tower, wherein the separable member is made of wood.

The present invention also provides a method of constructing a cooling tower comprising the steps of providing a plurality of columns made of a material containing reinforcing fibers and having a bottom end and a planar surface. A base is also provided. The columns are aligned vertically on the base and the bottom ends are secured to the base. A plurality of beams made of a material containing reinforcing fibers and having two ends and planar surfaces at their ends are provided. A mounting plate having a mounting surface is also provided. The method includes the step of bonding the mounting surface of the mounting plate to the planar surface at one end of one beam and to the planar surface on one vertical column to form a moment-transferring joint between the beam and the vertical column.

DETAILED DESCRIPTION

Figure 1:
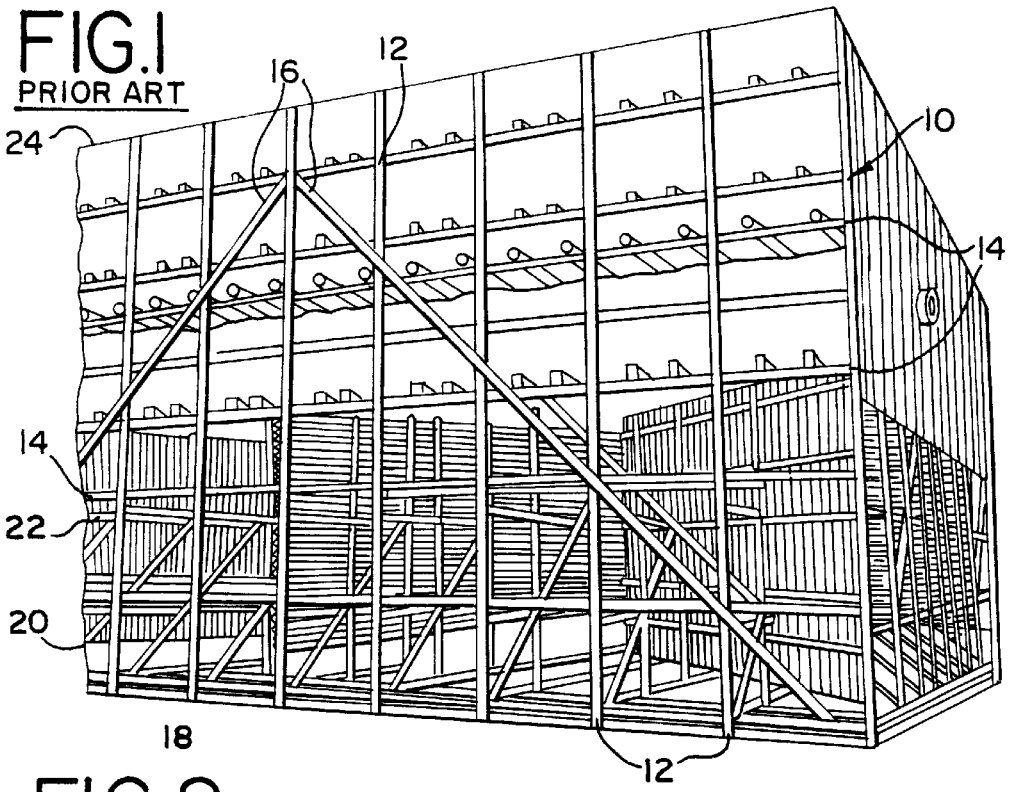
FIG.1 PRIOR ART
FIG. 1 is a partial perspective view of a prior art skeletal frame for a cooling tower, with parts removed for clarity of illustration.
Figure 2:
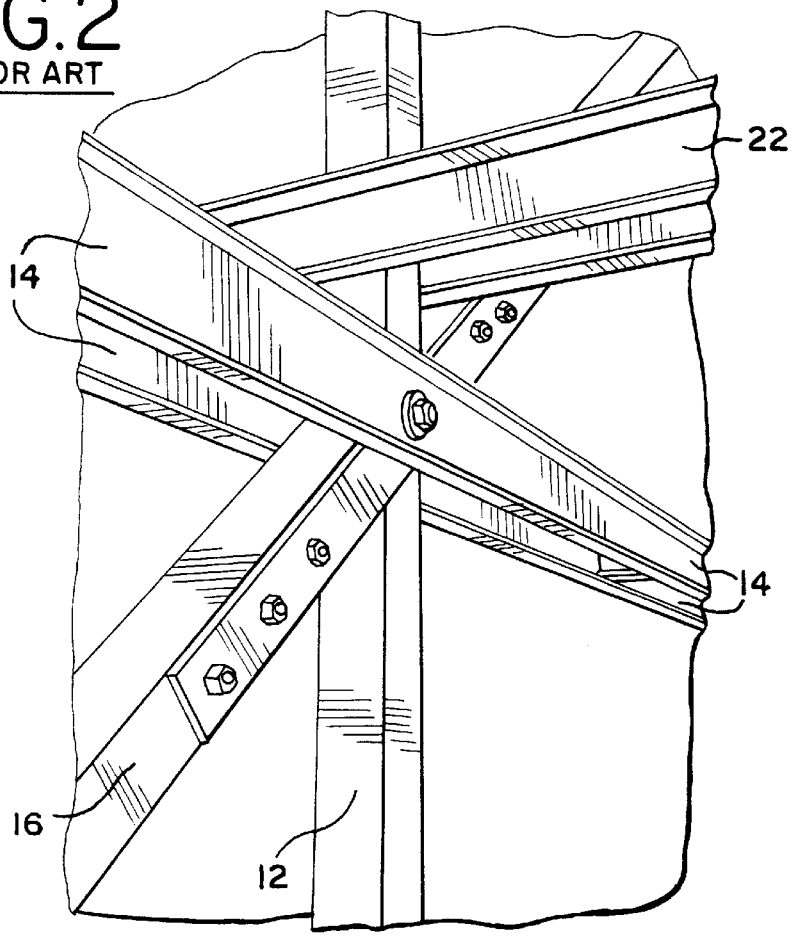
FIG.2 PRIOR ART
FIG. 2 is an enlarged partial perspective view of parts of a prior art skeletal structure such as that shown in FIG. 1, showing intersections of a column with horizontal beams and diagonal braces.

A sample of a prior art cooling tower frame structure is shown in FIGS. 1–2. As there shown, the cooling tower frame generally designated 10 includes a plurality of vertical columns 12 and horizontal beams 14. Typical prior art cooling tower frame columns 12 and beams 14 have been made of either wood or fiber reinforced plastic, and have had a plurality of diagonal bracing members 16 to provide lateral stability and resistance to wind and earthquakes. The structure illustrated in FIG. 1 is an incomplete cooling tower, with parts removed for clarity, to illustrate a typical overall structure in the prior art. A typical framework of diagonal braces is illustrated in FIG. 2, with diagonal beams 16 connected end to end and connected to various structural elements of the support frame at various locations.

In such a typical prior art structure, the columns 12 are spaced apart a distance of about six feet; in the illustrated prior art frame 10, the columns are spaced to provide bays 18, each bay having a width of about six feet. The frame structure 10 has several tiers or levels, the first ground level being the air inlet level 20, with upper levels 22 being vertically aligned with the air inlet level 20. The upper levels 22 are for carrying the fill material, the water distribution system, and the air intake equipment. Generally, in such counterflow structures, a large diameter fan and motor (not shown) are mounted on the roof 24 to draw air up from the air intake level 20 and through the upper levels 22 to exit at the fan.

As shown in FIGS. 1–2, such prior art structures have conventionally required diagonal bracing 16 at each level of the structure. Although other patterns of diagonal bracing than that shown in FIG. 1 could be and have been used, the bracing has generally been provided in pairs so that one set of braces is in tension while the other is in compression when the frame is subjected to lateral forces such as those resulting from winds and earthquakes. And the bracing has also been provided on other sides of the frame, and within the interior of the frame, to protect the frame from later forces coming from other directions. Unless some other form of protection against lateral forces is provided, diagonal bracing has generally been provided at and between each level of the frame, from the base to the top beam.

Figure 4:
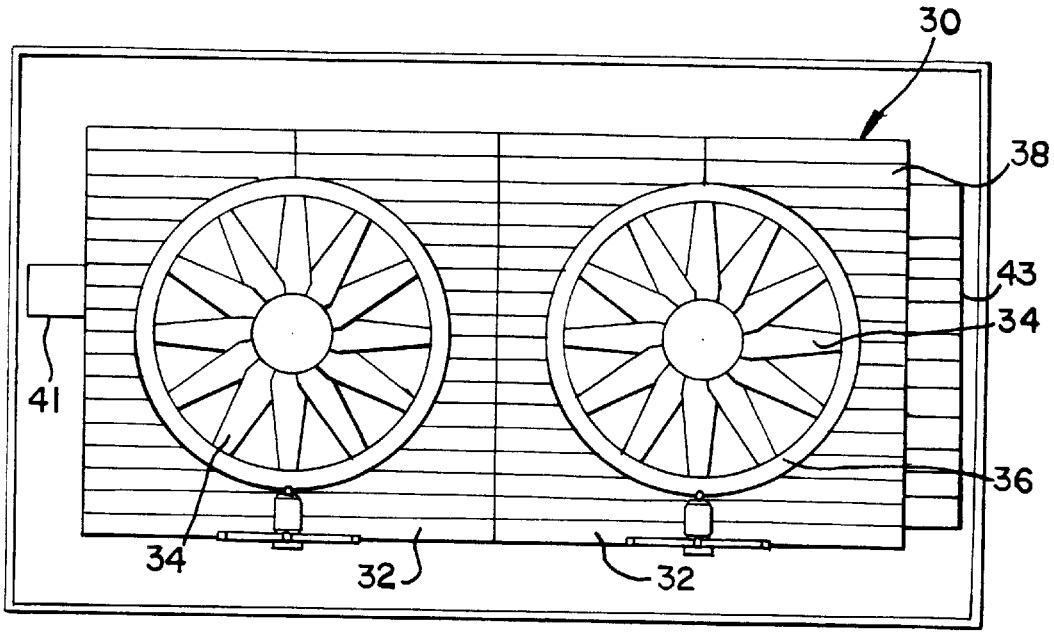
FIG. 4 is a top plan view of the two-cell cooling tower of FIG. 3.
Figure 3:
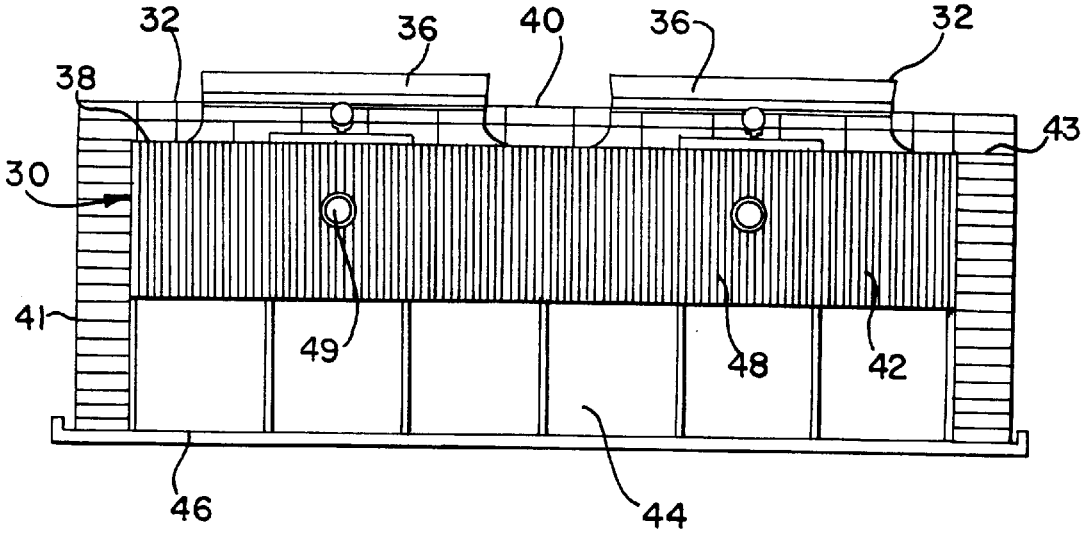
FIG. 3 is a side elevation of a two-cell cooling tower made according to the present invention.

A cooling tower according to the present invention is shown in FIGS. 3–4. It should be understood that the cooling tower shown in FIGS. 3–4 and the structures shown throughout the remainder of the drawings and described herein represent examples of the present invention; the invention is not limited to the structures shown and described. In the embodiment of FIGS. 3–4, the cooling tower, generally designated 30, comprises two connected cells 32. In the illustrated embodiment, each cell is a square about thirty-six feet on each side, so the entire cooling tower is about thirty-six by seventy-two feet. Each cell includes a fan 34 held within a fan shroud 36 that may generally comprise a fiber reinforced plastic structure that is assembled on top of the cooling tower 30. The fan 34 sits atop a geared fan-speed reducer which itself receives a drive shaft extending from a fan motor. The fan, fan speed reducer and motor may be mounted as conventional in the art, as for example, mounting on a beam such as a steel tube or pipe of appropriately chosen structural characteristics such as bending and shear strength and torsion resistance. The motor and beam may be outside of the roof or top of the cooling tower or within it. In the illustrated embodiment, the fan shroud 36 is mounted on top of a flat deck 38 on top of the cooling tower with a guard rail 40 around the perimeter. A ladder 41 or stairway 43 may also be provided for access to the deck, and walkways may also be provided on the deck.

Beneath the deck 38 are the upper levels 42 of the cooling tower and beneath the upper levels 42 is the bottom or air intake level 44. Beneath the air intake level 44 is a means for collecting cooled water from the fill system. In the illustrated embodiment, the collecting means is a basin 46, into which cooled water drips and is collected.

The exterior of the upper levels 42 may be covered with a casing or cladding 48 that may be designed to allow air to pass through into the cooling tower during, for example, windy conditions, and may be designed to be sacrificial, that is, to blow off when design loads are exceeded. The cladding may be made of fiber reinforced plastic or some other material and may comprise louvers.

Figure 5:
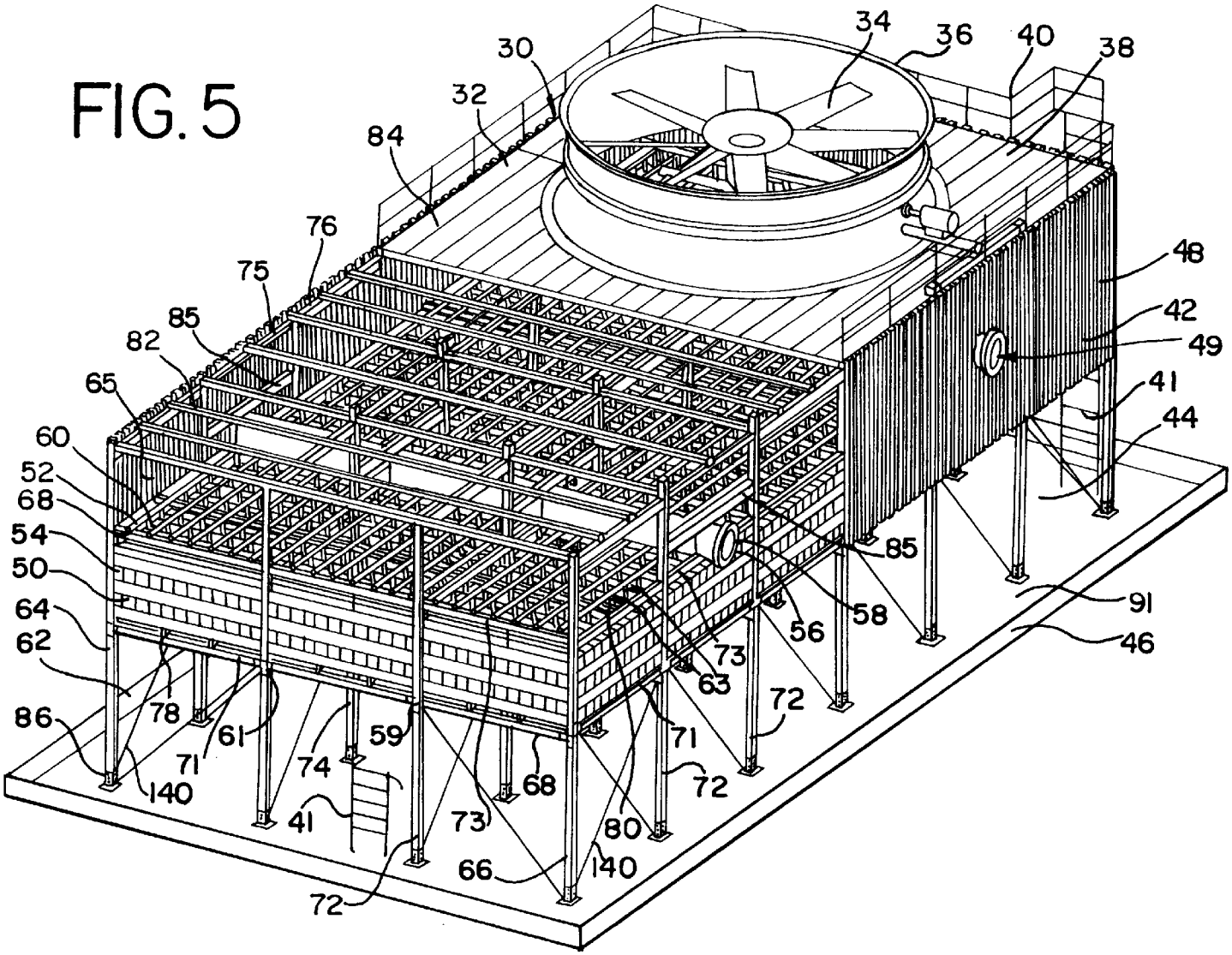
FIG. 5 is a perspective view of another two-cell cooling tower with parts removed for clarity of illustration.

As shown in FIG. 5, the upper levels 42 include a fill level 50 and water distribution level 52. The fill level is below the water distribution level, so that water is distributed to drip through the fill level to the collecting basin 46 below. Air is moved through the fill level past the water to cool it. The illustrated fan 34 comprises one possible means for causing air to move through the fill system, although other means can be used; for example, a blower could be used in a cross-flow arrangement.

As in the prior art, the fill level is filled with fill material 54, that is, heat transfer media. Generally, the illustrated fill is open-celled material that allows water to pass downwardly and air to pass upwardly, with heat transfer taking place between the water and air as they pass. Open celled clay tile may be used, as well as open cell polyvinyl chloride materials and any other open cell heat transfer media. In the illustrated embodiment, blocks of multiple generally corrugated vertical sheets of polyvinyl chloride are used as the fill material. Commercially available fill material may be used, such as, for example: fill material previously sold by Munters Corp. of Ft. Myers, Fla. under the designations 12060, 19060, 25060; fill material sold by Brentwood Industries of Reading, Pa. under the designations 1200, 1900, 3800, and 5000; fill material sold by Hamon Cooling Towers of Bridgewater, N.J. under the designations "Cool Drop" and "Clean Flow"; and grid-type fill materials; these fill materials are identified for purposes of illustration only, and the invention is not limited to use of any particular type of fill. The present invention is also applicable to cross-flow designs, and suitable fill arrangements for such designs may be made by those skilled in the art.

The water distribution system 49 in the level 52 above the fill level 50 includes a distribution header 56 that receives hot water from a supply pipe (not shown) which may be connected to the inlet 58 on the exterior of the cooling tower. One distribution header 56 extends across the width of each cell, and each is connected to a plurality of lateral distribution pipes 60 extending perpendicularly from the header 56 to the opposite edges of each cell. The lateral distribution pipes are spaced evenly across each bay 62, with eight lateral distribution pipes being provided in each of the six by six foot bays of the illustrated embodiment. Larger bays may be provided with an appropriate number and spacing of water distribution pipes provided.

Each lateral distribution pipe 60 has a plurality of downwardly directed spray nozzles 63 connected to receive hot water and spray it downward in drops onto the fill material 54, where heat exchange can occur as gravity draws the water drops down to the basin and the fan draws cool air up through the cooling tower. Each lateral distribution pipe may have, for example, ten nozzles, so that there may be eighty nozzles in each bay 62. This water distribution system 49 is shown and described for purposes of illustration only; other designs may also be useful.

The cooling tower of the present invention also has a skeletal support frame 64 to support the fan system, water distribution system 49 and fill material 54. The skeletal support frame 64 defines an interior volume 65 within which the fill material 54 and substantial portion of the water distribution system 49 are held. The skeleton or frame 64 of the present invention comprises a plurality of vertical columns 66 and horizontal beams 68. They are all simply shaped: elongate tubes with square or rectangular horizontal cross sections and flat faces, 67, 69, as shown in FIGS. 13–16. The surfaces 67, 69 of the columns 66 and beams 68 are co-planar at their junctures or intersections 61. The horizontal beams are attached to the columns in a novel manner, so that the completed frame is rigid, and so that the upper levels may be free from diagonal bracing, simplifying construction and lowering the cost of building this field erected tower.

The illustrated columns 66 and beams 68 of the skeletal support frame 64 are all made of a material containing glass fibers or some other reinforcing fiber. The illustrated fiber reinforced material is a pultruded fiber reinforced plastic, and may be made of either fire resistant or non-fire resistant materials, as will be understood by those in the art. Pultruded fiber reinforced plastic strands are generally those produced by pulling elongate glass or other reinforcing fibers through a die with a bonding material and allowing the elongate fibers and bonding material to set. Reinforcing fibers other than glass may be used, and the material containing the reinforcing fibers may be any conventional plastic or resin or other conventional material or matrix as will be understood by those in the art.

Figure 6:
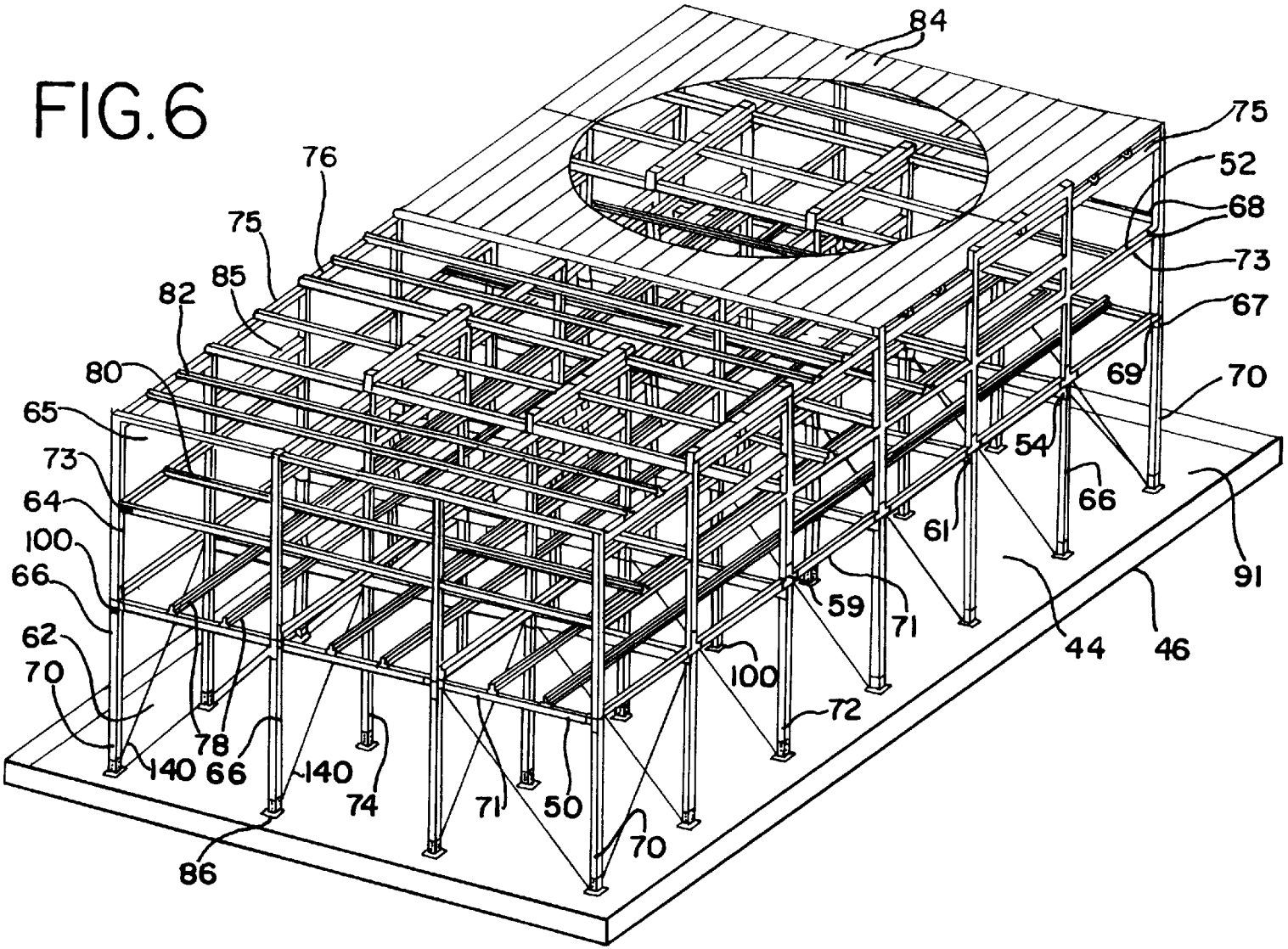
FIG. 6 is a perspective view of the two-cell cooling tower of FIG. 5 with parts removed for clarity of illustration.

As shown in FIG. 6, at each of the four corners of the cooling tower, each corner column 70 is connected to two first level horizontal beams 71 at the fill or first vertical level 50. The vertical end face columns 72 are each connected to three first level horizontal beams 71, and the interior vertical columns 74 are each connected to four first level horizontal beams 71. This first level of horizontal beams 71 supports the fill material 54 at the fill level 50, spaced above the basin 46. These vertical columns are connected to the same number of second level horizontal beams 73 at the next higher water distribution level 52 and to the same number of third level horizontal beams 75 at the next higher deck support level 76. Each successive level of beams is spaced vertically above the preceding levels.

To support the fill material 54 on the fill level 50, the invention includes a plurality of horizontal fill support lintels 78 extending between and supported by parallel first level horizontal beams 71. The fill support lintels 78 are all on the same plane, and the blocks of fill material 54 may be supported between and on adjacent lintels 78 and adjacent lintels and parallel horizontal beams 71. The elevations of the first horizontal beams 71 are set so that the beams on which the lintels rest are slightly below the first level horizontal beams that are perpendicular to the beams on which the lintels rest so that the tops of the lintels are in the same plane as the tops of the first level beams parallel to the lintels, as seen in FIGS. 5 and 6. The lintels may be secured in place with removable tech screws inserted through the lintels into the underlying horizontal beams.

At the next level, a separate system of water distribution support lintels 80 is provided at the second or water distribution support level 52, which is the second vertical level. The water distribution support lintels 80 are perpendicular to the lateral distribution pipes 60 and extend between and are supported by second level horizontal beams 73. In the illustrated embodiment, the water distribution support lintels 80 are perpendicular to the fill support lintels 78 and support the lateral distribution pipes and nozzles above the fill. The perpendicular second level horizontal beams 73 may be set at two levels, so that the tops of the lintels are in the same plane with the second level beams parallel to the lintels.

A separate system of deck support lintels 82 is provided above and spaced from the water distribution support lintels 80 at the deck support level 76. The deck support lintels 82 are supported on the third level horizontal beams 75 and may support the decking planks 84 and the fan 34 and fan shroud 36. The perpendicular third level horizontal beams 75 may be set at different elevations so that the tops of the lintels are in the same plane with the tops of the beams that are parallel with the lintels.

The water distribution header 56 may be supported from underneath by one of the second horizontal beams 73. Alternatively, it may be desirable to provide additional, thicker horizontal suspension beams 85 between the two vertical columns between which the water distribution header 56 runs. With such a construction, instead of supporting all of the weight of the header at one point at the center of the horizontal beam beneath the header, the weight can be suspended from two points spaced from the center, creating less opportunity for the lower beam to creep. This suspension could be from two bolts or pins extending through the beam and through a strap surrounding the header. A portion of the remainder of the water distribution system 49 may be supported by the second level horizontal beams 73.

Figure 7:
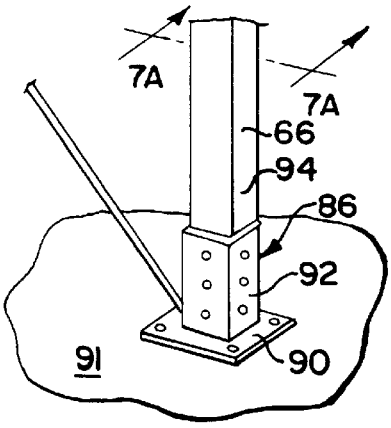
FIG. 7 is an enlarged partial perspective view of the bottom end of a column with one embodiment of a footing that may be used with the present invention.

In the illustrated embodiment, the concrete collecting basin 46 defines a base on which the vertical columns 66 may be mounted through footings 86. As shown in FIG. 7, each footing may have a flat base plate 90 to be mounted flush with the horizontal floor 91 of the basin, and a vertical casing 92 in which the bottom end 94 of the vertical column 66 is held. In cross-section, the vertical casing is shaped to mate with the column so that there is a relatively tight fit between the casing and the column. The flat base 90 of each footing may be bolted to the floor 91 of the basin to maintain the position of the cooling tower on the basin.

Figure 9:
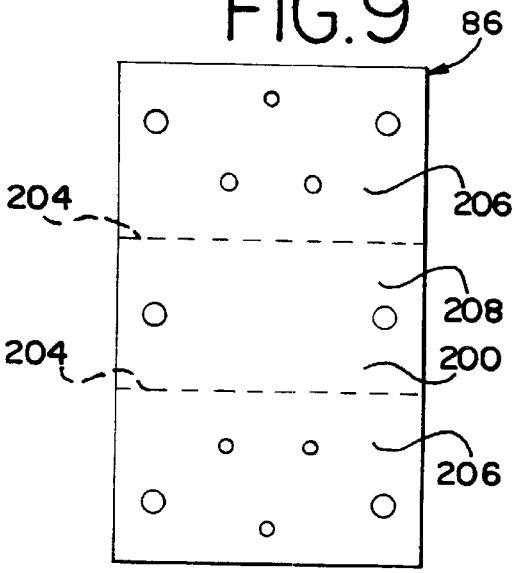
FIG. 9 is a top plan view of the sheet used for the footing bracket of FIG. 8 laid flat and prior to its being bent into the shape shown in FIG. 8.
Figure 11:
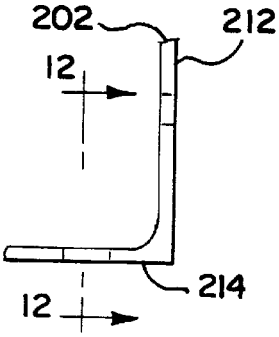
FIG. 11 is a side elevation of a bracket that may be used with the footing bracket of FIG. 8 or with other angles as a footing for the present invention.
Figure 12:
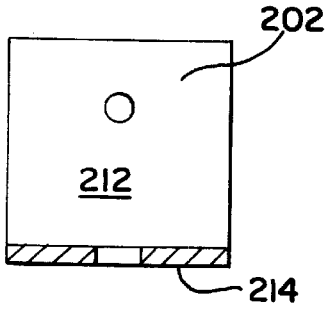
FIG. 12 is a cross-section taken along line 12—12 of FIG. 11.

An alternate footing is shown in FIGS. 8–12. As there shown, an U-shaped bracket 200 may be used in conjunction with a pair of angles 202 as a footing 86. The U-shaped bracket 200 may be formed from a flat metal sheet, as shown in FIG. 9, bent along fold lines 204 so that the end sections 206 are perpendicular to the center section 208. The width of the center section 208 between the fold lines 204 is great enough to tightly hold the bottom end 94 of the column 66 between the upstanding sides defined by the end sections 206. The bracket 200 may be attached to the bottom end of the column through one or more bolts 210 extending through the column and both sides 206 of the bracket.

Figure 10:
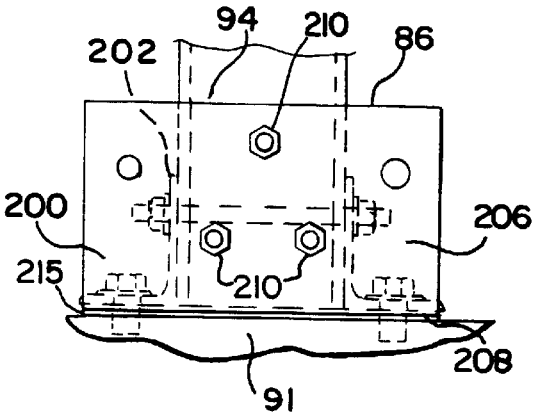
FIG. 10 is a side elevation of the bottom of a column with the footing bracket of FIG. 9 with two angles mounted on the bottom end of a column.

To secure the bracketed column end to the floor, the pair of angles 202 may be bolted to the column end as shown in FIG. 10 and then the entire assembly can be bolted to the floor of the basin with bolts extending through the angles and the underlying center section 208 of the bracket 200. Alternatively, a group of angles 202 could be used to connect each column to the floor of the basin, with the vertical surfaces 212 of the angles bonded to the column end as described below.

Alternatively, it may be desirable to provide an upstanding member that is received within the column rather than encasing it. In any of these embodiments, two perpendicular flat surfaces, such as the flat base 90 and vertical casing 92, the center section 208 and sides 206 of the bracket, and the two faces 212, 214 of the angle members, are provided for securing the footing to the column 66 and to the base 46; bolts, for example, may be used to secure the footings to the concrete floor of the basin.

Figure 7A:
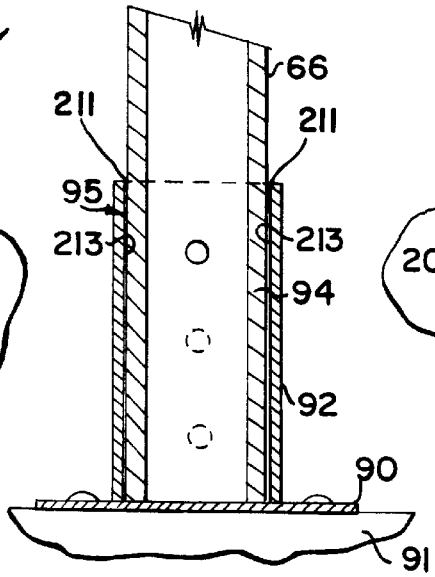
FIG. 7A is a cross-section taken along line 7A—7A of FIG. 7.
Figure 8:
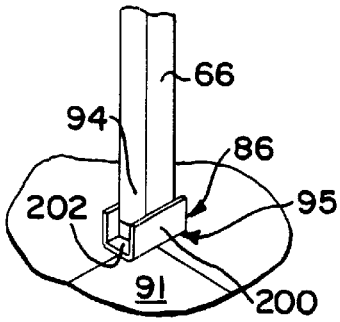
FIG. 8 is an enlarged partial perspective view of another embodiment of a footing that may be used with the present invention.

In some instances it may be desirable to bond the bottom end 94 of the column 66 to the vertical casing of the footing 86, or to the vertical end sections 206 of the U-shaped bracket 200 and angles 202. In some other instances it may also or alternatively be desirable to bond the flat base plate 90 footing 86 to the base or floor 91 or the basin. Thus, as shown in FIG. 7A, there may be a layer of bonding material or adhesive 211 between the inside walls 213 of the vertical casing 92 of the footing; bonding material or adhesive may also be present between the vertical end sections 206 of the U-shaped bracket and the faces of the bottom end 94 of the column 66, or between the vertical faces 212 of the angle members 202 and the faces of the bottom end of the column. As shown in FIG. 10, there may be a layer of adhesive or bonding material 215 between the center section 208 of the bracket 200 and the floor 91; there may alternatively be a layer of bonding material between the bottom surfaces 214 of the angles 202 and the floor 91; there may be bonding material or adhesive between the flat base 90 and the floor 91. However, in many installations the columns may be attached to the footings and the footings to the floor without the use of adhesive or bonding material.

The present invention provides a unique joint between each column 66 and beam 68. While traditional bolted joints have allowed for relative rotational movement between such columns and beams, the present invention provides substantially rigid joints, with no relative motion at design loads. While in traditional joints there is no transfer of moments between the beams and the columns, in the present invention there is such a transfer. The joints 59 may be characterized as being moment-transferring, meaning that there is substantially no relative motion between the joined members at design dead weights and lateral loads. The connections between the bottom ends 94 of the columns 66 and the base 46 may be similarly moment-transferring. Accordingly, in the present invention, the design limitation for lateral forces is the stiffness of the vertical columns. The tower can be constructed to withstand anticipated shear loads without using cross-bracing or shear walls, or with reduced use of such elements.

To provide such a moment-transferring joint 59 between the columns and beams, the present invention uses a combination of a rigid mounting plate and bonding material. At each juncture or intersection 61, a mounting face or surface 101 of a mounting plate 100 is placed to cover and bond to a part of the meeting co-planar surfaces 67, 69 of the vertical column 66 and horizontal beam 68. In the illustrated embodiment, the mounting plates cover the entire widths of the flat co-planar faces 67, 69 of each of the meeting members 66, 68, and extend laterally to cover the entire width of a part of the flat face of each of the adjoining meeting members. Between the column and beam faces 67, 69 and the juxtaposed inner mounting face 101 of the mounting member is a thin layer of adhesive or bonding material 102. The adhesive 102 serves to bond the plate to the column and beam to create a moment-transferring connection or joint 59, with substantially no relative movement between the plate and the members to which it is adhered, and hence substantially no relative movement between the joined column and beam. Without relative movement, moments can be transferred from the beams to the columns.

With the structure of the present invention, the upper levels 42 of the cooling tower may be substantially free from diagonal bracing against lateral and shear loads. This freedom from diagonal bracing is particularly advantageous in the interior volume 65 of the structure, because the fill levels are then free from interference by the braces, as is the water distribution level, making it easier and faster to install both the fill and water distribution system.

Sample mounting plates useful in the present invention are illustrated in FIGS. 13–20B. As there shown, there need only be a few basic shapes of mounting plate that need be provided to meet the needs of field erection of cooling towers. A first basic shape is that shown in FIGS. 14 and 17 for a typical connection at a corner between a vertical column and a horizontal beam meeting the column. As shown, this mounting plate 100 has an elongate area 103 for mounting to the vertical column 66 and an integral beam mounting area 104 of a shorter length. Both areas 103, 104 have widths of at least about five inches, for use with a vertical column having a width of about five inches. Generally, it is preferred that the beam mounting area 104 have a length to at least cover the width of the beam. In the illustrated embodiment, there may be beams with widths of, for example, five, seven or ten inches, so a universal mounting plate may be made to cover a ten-inch beam. In this way, one size mounting plate can be provided in a kit and used for any size beam likely to be used in the cooling tower frame.

Figure 13:
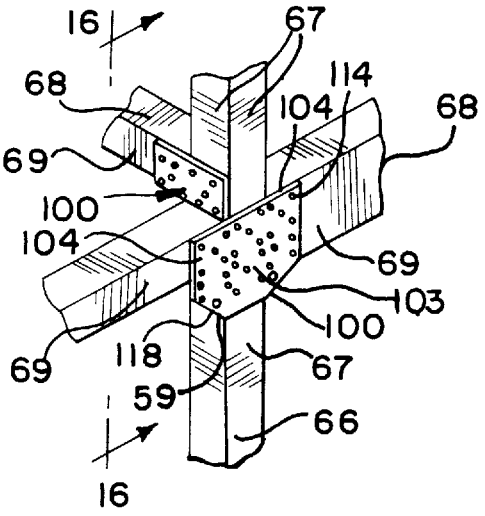
FIG. 13 is an enlarged partial perspective view of a moment-transferring joint between a column and three beams, with one beam larger than the others.
Figure 14:
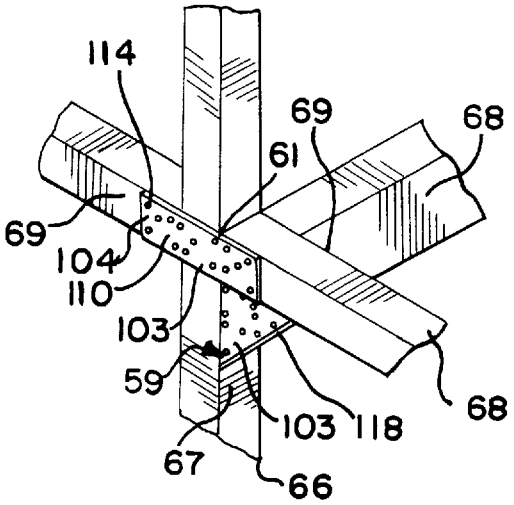
FIG. 14 is an enlarged partial perspective view of another moment-transferring joint between a column and three beams, with one beam larger than the others.
Figure 18:
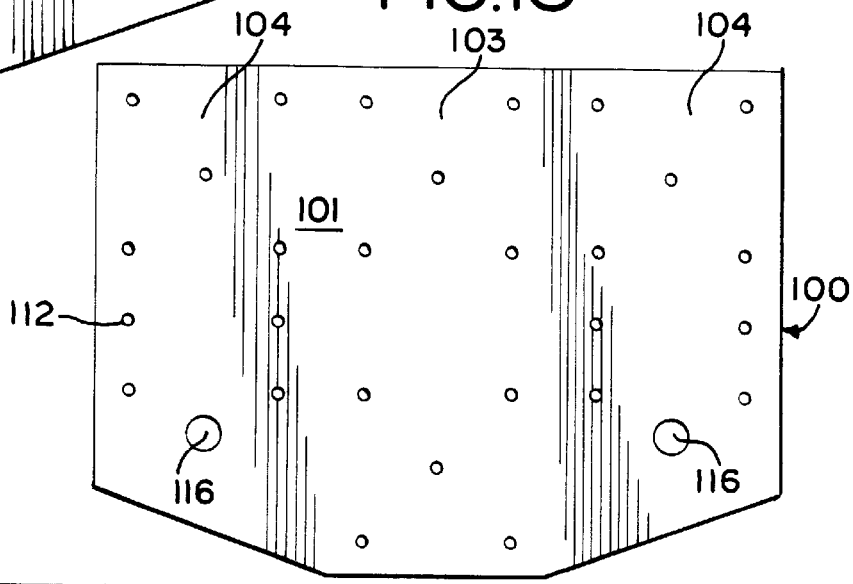
FIG. 18 is a plan view of another embodiment of a mounting plate of the present invention.
Figure 19:
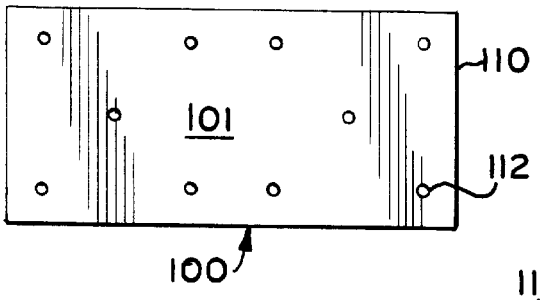
FIG. 19 is a plan view of another embodiment of a mounting plate of the present invention.

Another basic shape is shown in FIGS. 13 and 18. That shape is for use at intersections where more than one horizontal beam 68 is joined to one vertical column 66. The shape is similar to the first shape, but two co-planar beam mounting areas 104 are provided on both sides of the co-planar elongate area 103 for attachment to the vertical column.

Figure 15:
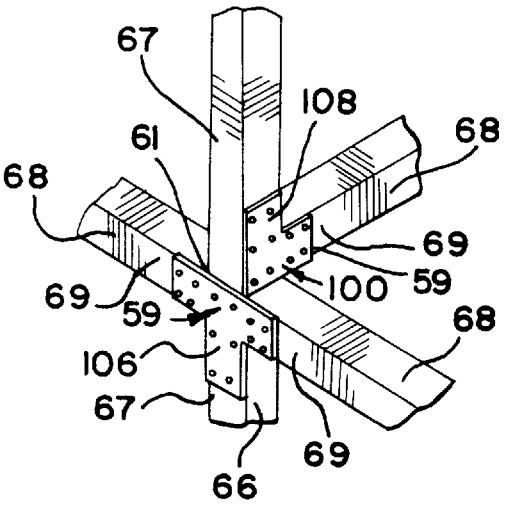
FIG. 15 is an enlarged partial perspective view of another moment-transferring joint between a column and three beams of the same size.

Alternate mounting plate shapes are shown in FIGS. 15–16 and 19–20. As there shown, the mounting plates can comprise T-shapes 106, as shown in FIG. 15, L-shapes 108, as shown in FIG. 15, and rectangular shapes 110, as shown in FIG. 13–14 and 19–20. As shown in FIGS. 13–16 and 21, the skeletal frame structure may include all or some of these various shapes of mounting plates, depending on the size of beam used.

Figure 16:
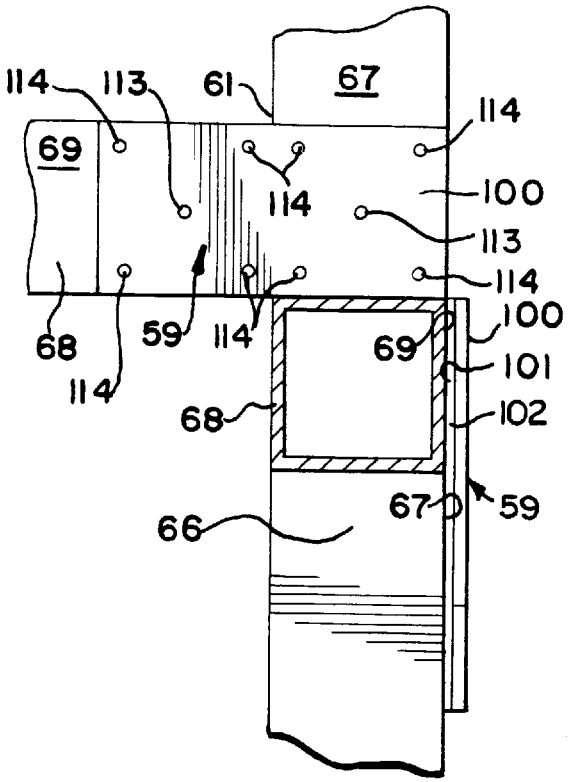
FIG. 16 is a cross-section taken along line 16—16 of FIG. 13.
Figure 17:
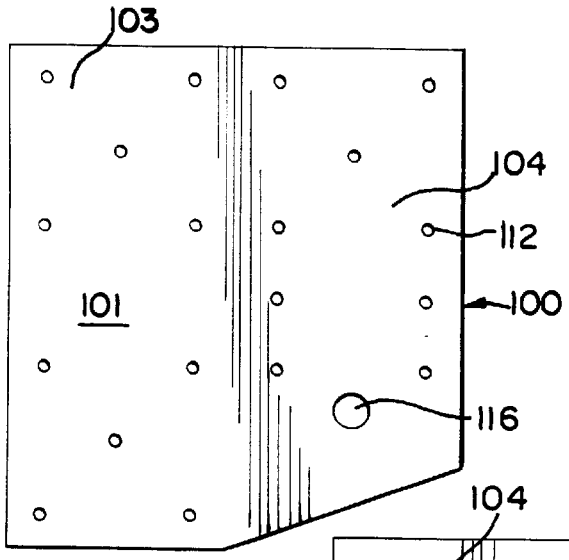
FIG. 17 is a plan view of an embodiment of a mounting plate of the present invention.
Figure 20:
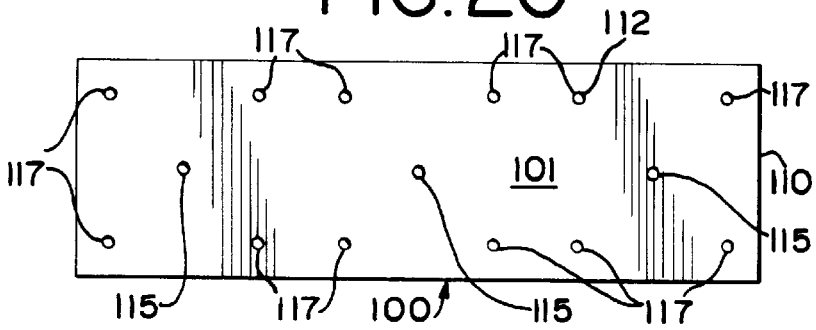
FIG. 20 is a plan view of another embodiment of a mounting plate of the present invention.

The mounting plates 100 preferably have pre-drilled holes 112 through which self-tapping screws 113 and tech screws 114 may be screwed into the columns 66 and beams 68. The self-tapping screws 113 and tech screws 114 are placed before the adhesive sets, during construction, and serve to hold the cooling tower frame structure together during construction. Generally, in the illustrated embodiment, the self-tapping screws 113 are inserted through holes in the mounting plates 100 and through holes in the faces 67, 69 of the columns and beams 66, 68; the tech screws 114 are inserted through holes in the mounting plates 100 and into the faces 67, 69 of the columns and beams 66, 68, forming their own openings into the columns and beams. These connections bear the dead load of the structure during construction. These connections also serve to hold the inner mounting face 101 of the mounting plate and faces 67, 69 of the adjoining columns and beams in intimate contact with the adhesive so that bonding occurs between these elements. As shown in FIGS. 16 and 20, the self-tapping screws 113 may, for example, be used at the interior holes 115 of the mounting plate and the tech screws 114 at the outer holes 117 around the perimeter of the mounting plate. Additionally or alternatively it may be desirable to provide holes 116 for one-quarter inch through bolts 118 to extend through the plate and into the beam and column to locate and space the beam and column during construction.

The mounting plates may be made of, for example, stainless steel or galvanized metal, or may be fiber reinforced plastic plates. Any material may be used that provides the needed strength and that will withstand the expected environment, particularly the wet environment in the interior of the cooling tower. In the illustrated embodiment, the mounting plates may be 12 gauge 304 or 316 stainless steel. In some applications, it may be desirable to use a mix, with some materials being used in the interior of the tower and others being used at the perimeter, for example.

Figure 20A:
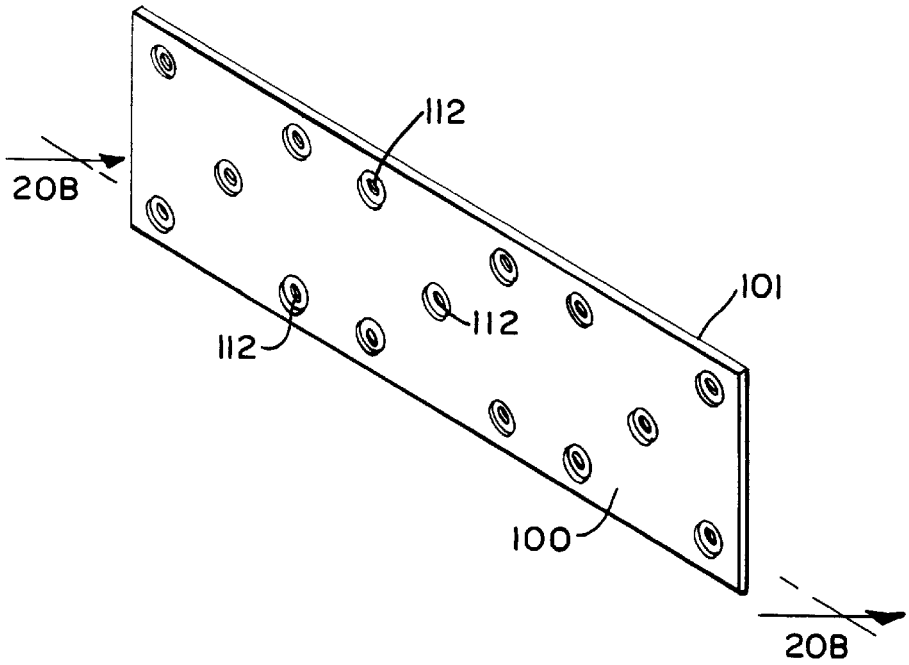
FIG. 20A is a perspective view of an embodiment of a mounting plate of the present invention, having a layout like the embodiment of FIG. 20 but with a dimpled surface.
Figure 20B:
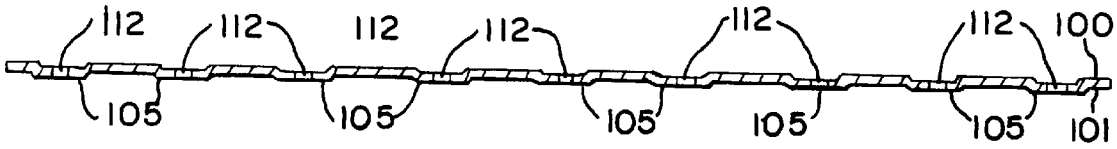
FIG. 20B is a cross-section taken along line 20B—20B of FIG. 20A.

In the illustrated embodiment, the adhesive or bonding material 102 is a thin layer placed between the inner mounting face 101 of each mounting plate 100 and the co-planar faces 67, 69 of each column 66 and beam 68 to which the mounting plate is secured. The adhesive strength may vary with the thickness of the bonding material. The adhesive may typically be on the order of 2–15 mils in thickness. To assist in ensuring that the proper amount of adhesive is present, the inner mounting face 101 of the mounting plate 100 may be dimpled as shown in the embodiments of FIGS. 20A and 20B, with annular raised areas 105 surrounding the pre-drilled holes 112 for the screws. The heights of the raised areas may be used to define the available thickness for the adhesive, since the raised areas 105 of the inner mounting face 101 may abut against the co-planar faces 67, 69 of the column 66 and beam 68, with bonding material extending between the remainder of the inner face 101 and the co-planar faces 67, 69. Such dimpling may be used with metal mounting plates 100.

Thus, in the illustrated embodiments, the mounting surface or face 101 of the mounting plates 100 may either be planar or may have raised areas 105. The mounting surface or face 101 is on one side of the mounting plate. The mounting surface or face may comprise substantially the entire inner surface of one side of the plate or may comprise an area or areas on the inner surface on one side of the plate.

Relief holes may also be provided in the mounting plates 100 so that excess adhesive may flow out. Such holes may also be advantageous in that the adhesive may extend from the surface of the columns and beams to the surface of the mounting plate and through the thickness of the mounting plate.

The adhesive or bonding agent 102 should be one that is waterproof when cured and that will bond to both the material used for the beams and columns and the material used for the mounting plates. The adhesive or bonding material may be, for example, an epoxy, such as "Magnobond 56 A & B" available from Magnolia Plastics of Chamblee, Ga.; this example is a high strength epoxy resin and modified polyamide curing agent adhesive designed for bonding fiber reinforced plastic panels to a wide variety of substrates. Alternatively, a methacrylate adhesive may be used. Suitable methacrylate adhesives are "PLEXUS AO420" automotive adhesive and "PLEXUS AO425" structural adhesive available from ITW Adhesive Systems of Danvers, Mass. It is expected that other construction adhesives will work in the present invention. For example, it may be desirable to use an adhesive that is provided in sheet form, such as an epoxy carried on both sides of a thin sheet or film; a 3M adhesive tape known as model VHB, available from 3M of St. Paul, Minn., or similar products such as automotive adhesives may be used; these and similar products are intended to be encompassed in the terms "adhesive", "bonding agent" and "bonding material". These adhesives or bonding materials are identified for purposes of illustration only; other adhesives or bonding materials may be used and are within the scope of the invention.

In selecting an adhesive or bonding material 102, it is desirable to select one that interacts favorably and is compatible with the constituents of the beams and columns, such as any release agent in the fiber reinforced material that may migrate to the surface, so that the bonded joint is not weakened by the interaction of the bonding material and beam and column constituents. Some materials used in some pultrusions can cause failure of the bond of the epoxy or methacrylate or other bonding material. Certain release agents do not affect the strength of the bond and should be used in the manufacturing process. One example of a release agent compatible with the above-identified adhesives is sold by Blendex, Inc., of Newark, N.J., as "TECH-LUBE 250-CP"; this product is identified as being a proprietary condensation product of resins, fatty glycerides and organic acid derivatives mixed in with modified fatty acids and phosphate esters.

It is also desirable to use an adhesive that can be applied, and that will set up and cure in a wet environment, and that will not lose its strength in a wet environment. The cured joint should not be so flexible as to allow for relative movement between the columns and beams at anticipated loads: the bond strength should be great enough to maintain the rigidity of the joints through anticipated loading of the structure; although the joints may not be rigid through all loading that they will experience in use, they should maintain their rigidity through a selected range of lateral forces.

When the adhesive 102 sets up and cures, it forms a rigid joint that not only bears the dead load of the structure, but also braces the frame and cooling tower against lateral forces, transferring moments from the horizontal beams to the vertical columns. In this way, the vertical columns' rigidity and resistance to bending from the vertical may be the limiting design criteria for anticipated wind and earthquake loads.

One result of using the rigid joints of the present invention is that the cooling tower frame needs fewer or no diagonal braces, particularly in the upper levels 42. Although it may be desirable to include some diagonal bracing at the bottom air intake level 44, as shown in FIGS. 5–6, it is generally unnecessary to do so in the upper levels since the moment-transferring joints 59 transfer shear loads from lateral forces to the vertical columns. Decreasing the number of diagonal braces is advantageous in reducing material costs for the tower, reducing construction time and costs, and improving accessibility of the interior volume of the cooling tower for placing, replacing, cleaning or repairing parts such as the nozzles in the water distribution system. The number and variety of parts needed at a construction site are significantly reduced, allowing for even greater construction efficiency. Moreover, it may also be possible to produce modular frame units for even faster assembling on-site.

Using moment-transferring joints 59 also has other design advantages: a beam of a typical span may have increased strength, or the span of the beams may be significantly increased while maintaining or achieving a desired load capacity, beam length to deflection ratio and service factor. For example, comparing a theoretical 5 by 5 fiber reinforced plastic beam with simple support to one with fixed support, at a length to deflection ratio of 180 inches to 1 inch, the beam's maximum capacity for a simple support would be expected to be around 191 pounds per foot, while a fixed support beam's capacity would be expected to be around 720 pounds per foot; for a length to deflection ratio of 360 inches to one inch, a beam with simple support would be expected to have a capacity of around 99.5 pounds per foot, while a fixed support beam would be expected to have a capacity of about 360 pounds per foot. These increases in capacity of the beams are expected to be accompanied by acceptable degrees of creep or sag of the beam over time. Acceptable service factors, that is, the ratios of stress at failure to working stress, are expected to be achieved with the present invention with increased spans, and increases in service factors are expected to be achieved at conventional and some increased spans. Thus, the present invention allows for increasing the span between horizontal beams, thereby decreasing the number of vertical columns necessary for supporting the mechanical load. The present invention also allows for greater design flexibility: in applications where a lower service factor is acceptable, the present invention allows for the tower to be designed to meet that lower criteria while minimizing the number of parts and simplifying construction. And where a higher service factor is desired, spans could be set at shorter lengths, such as at a conventional six feet, to decrease the creep and still simplify construction since fewer parts are required and since cross-bracing is unnecessary. All of these advantages are expected to be achieved without the structure racking, that is, the structure should remain upright under lateral loading without lateral displacement.

Figure 21:
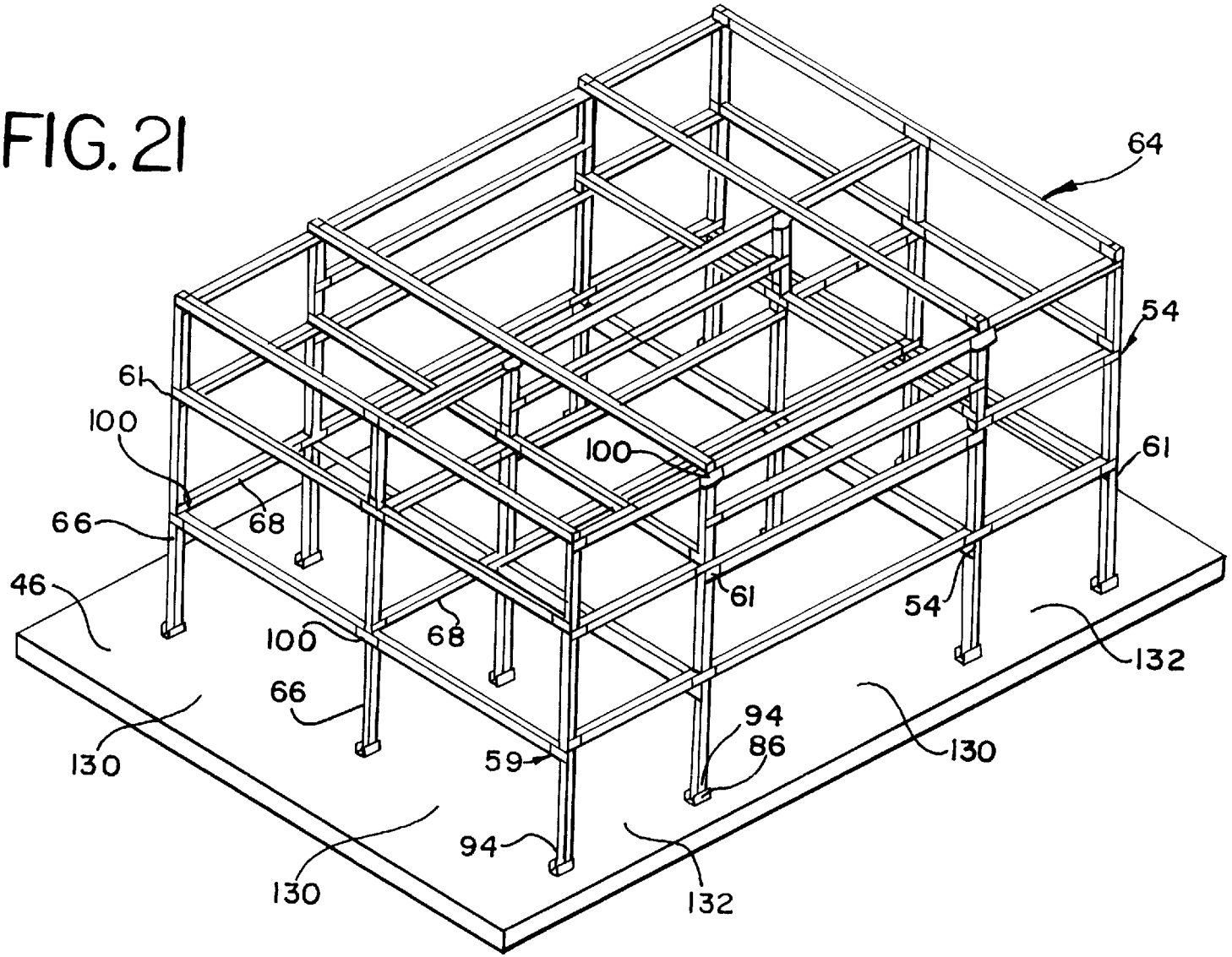
FIG. 21 is a perspective view of an alternate skeletal support structure according to the present invention.

An example of the increased span possible is shown in FIG. 21, where a hybrid of spans are used in the cooling tower frame. As there illustrated, instead of standard bays with all columns spaced apart a distance of six feet, there may be bays 130 with 12 feet between columns, along with bays 132 with six feet between columns. It should be understood by those in the art that this layout of the vertical columns is given for purposes of illustration only: there are a myriad of design possibilities, with, for example, a single 12 by 12 foot bay, or many 12 by 12 foot bays connected in various configurations, with or without other sized bays. Other dimensions may also be utilized, depending on the site and the design criteria. Significantly, the present invention has greatly increased design flexibility, allowing for cost-effective designs to be created suitable for the particular installation.

In addition, in traditional fiber reinforced material, relative micromovement between the fasteners and the fiber reinforced plastic beams or columns may cause wear in the fiber reinforced material at the connection, continually increasing the amount of play and weakening the frame structure. With the present invention, this micromovement is substantially stopped.

It may also be desirable in some installations expected to be under a high load to create a moment-transferring joint 95 at the connection between the bottom 94 of each vertical column 66 and the footing 86. This rigid connection may be achieved by using an adhesive or bonding material 211 as described between the column 66 and the footing 86. Although in most installations it is expected that use of anchor bolts and a footing of adequate thickness will firmly fix the footing to the base, it may be desirable in some installations to use an adhesive or bonding material 215 between the footing 86 and the base 46, to create a moment-transferring connection between them, increasing the stiffness of the columns and enhancing the capacity of the tower frame to withstand lateral loads. The bonding material 211, 215 may be between the perpendicular bonding surfaces 90, 92 or 208, 206, or 212, 214 of the footing 86 and the bottom 94 of the column 66 and between the base 46 floor 91.

Figure 23:
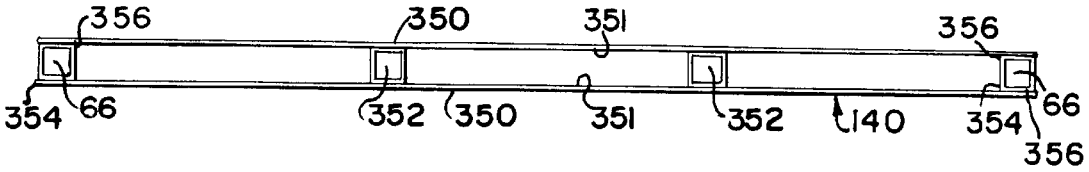
FIG. 23 is a cross-section taken along line 23—23 of FIG. 22.
Figure 22:
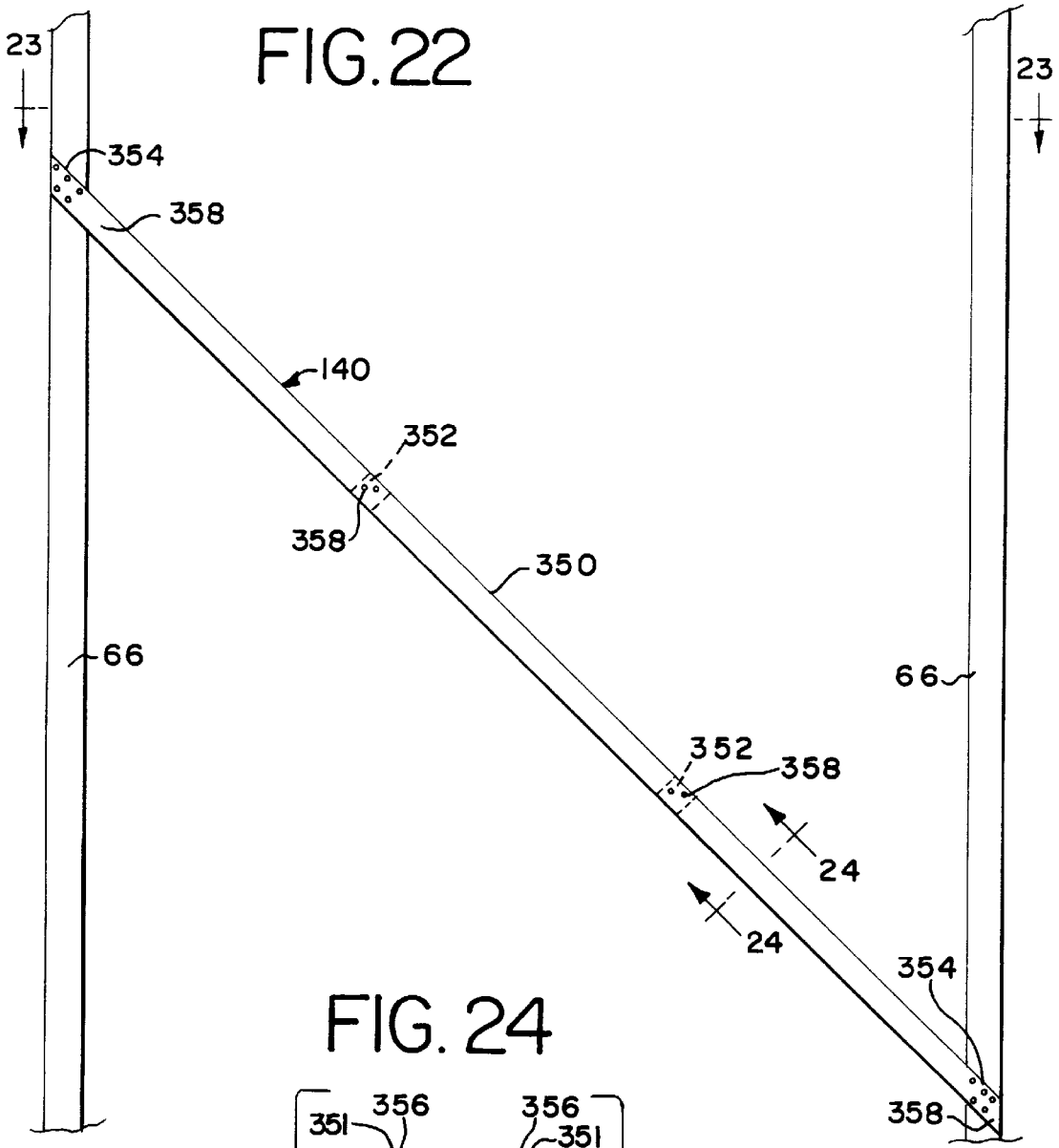
FIG. 22 is a partial side elevation of a pair of columns braced with a diagonal channel brace member.
Figure 24:
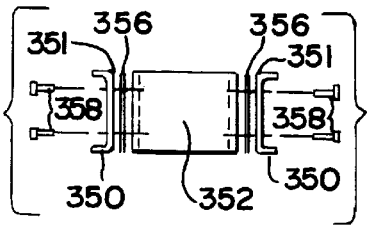
FIG. 24 is a cross-section taken along line 24—24 of FIG. 22.*

As indicated, and as shown in FIGS. 5–6, diagonal braces 140 may be included on the air intake level 44. It may be desirable to use a plurality of C-channel braces 350 as shown in the embodiment of FIGS. 22–24. Alternatively, metal rod braces may be used as shown in the embodiment of FIGS. 25–26 for smaller towers.

In the embodiment illustrated in FIGS. 22–24, a pair of adjacent columns 66 are braced by a pair of parallel C-channel braces 350 extending diagonally between the adjacent columns 66, with the columns 66 between the flat faces 351 of the two braces 350. A plurality of tubular spacers 352 of the same width as the columns 66 may be placed between the faces 351 of the braces 350 at intervals to space the braces and reinforce them. The tubular spacers may be of the same width as the columns. At the intersections of the braces 350 and the columns 66, the braces 350 may be attached to the columns 66 to define moment-transferring connections 354 through the use of bonding material 356 disposed between the mating planar surfaces of the braces and the columns. Bonding material 356 may also be disposed between the mating planar surfaces 351 of the C-channel braces and the spacers 352. Thus, moment-transferring connections may be made between the braces 350 and the columns 66 and between the braces 350 and the spacers 352.

The bonding material 356 for the embodiment illustrated in FIGS. 22–24 may be the same as that used for the other moment-transferring connections in the structure, such as an epoxy or methacrylate adhesive and other adhesives described. The C-channel braces 350 and spacers 352 may all be made of a fiber-reinforced plastic material. Tech screws 358 may be installed through the C-channel braces 350 and the columns 66 and through the C-channel braces and into the spacers 352 to take the construction load during field erection of the cooling tower.

Figure 26:
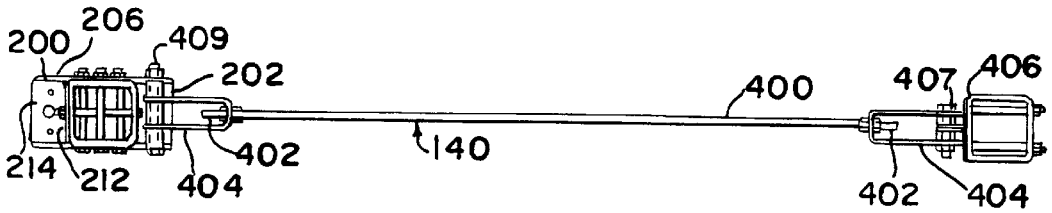
FIG. 26 is a cross-section taken along line 26—26 of FIG. 25.
Figure 25:
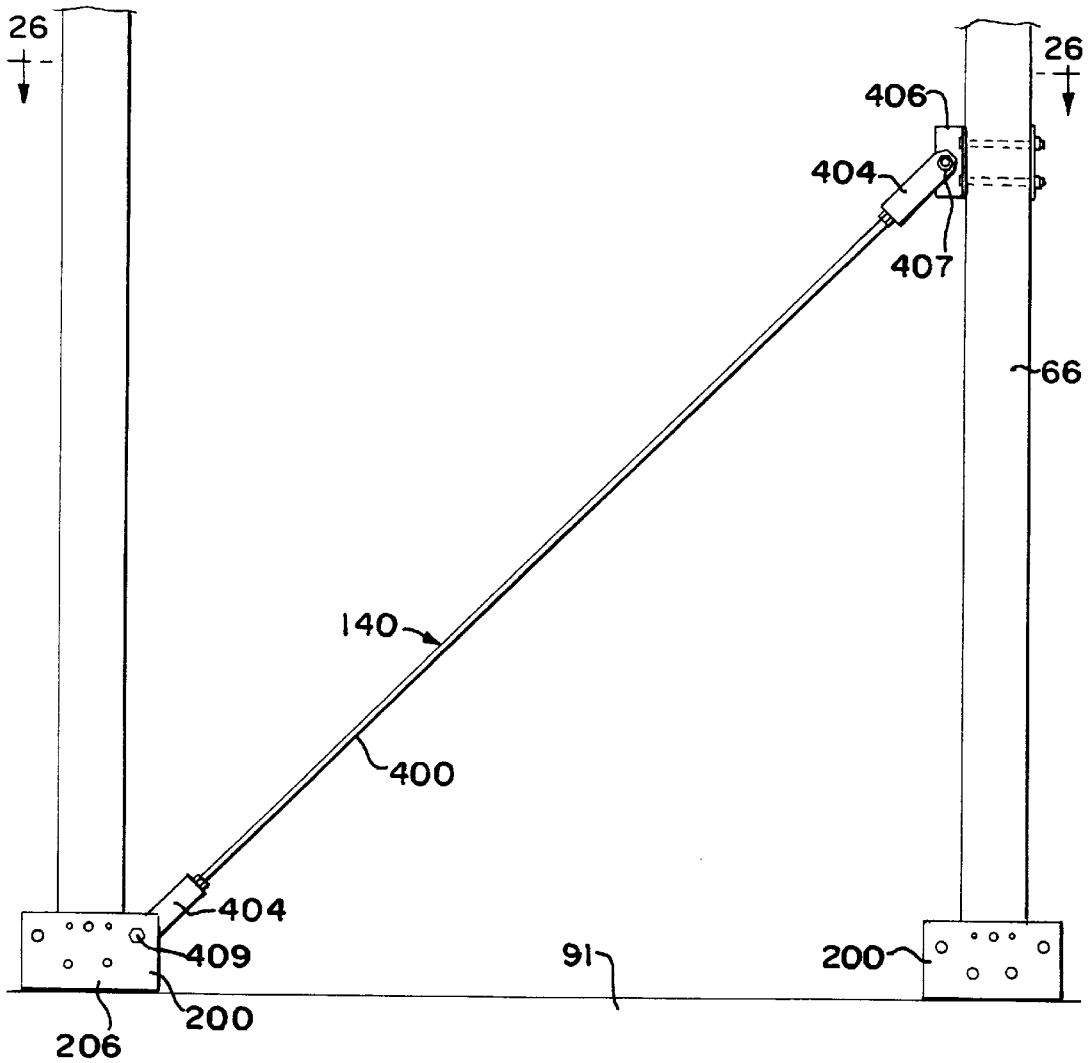
FIG. 25 is a partial side elevation of the bottom air intake level of a cooling tower, showing adjacent columns braced with an alternate brace.

As an alternative, particularly on smaller cooling tower structures, the brace 140 may comprise a metal rod 400 as shown in FIGS. 25–26. The rod may be made out of stainless steel, such as 304 or 316 stainless steel rod, or galvanized metal, for example, with threaded ends 402 received in an apertured clevis 404 having co-linear apertures for pivotal mounting on an apertured bracket 406 mounted through a pivot pin 407 at a point on one column 66 and to a mounting member or bracket at the vertically spaced position on the adjacent column. As shown, if an U-shaped bracket 200 is used as a footing, its two vertical sides 206 may have apertures to align with the co-linear apertures on the mounting bracket and receive a bolt 409 on which the mounting bracket may pivot. The threaded ends of the rod may have two sets of nuts so that the rod operates in both tension and compression to brace the structure.

Use of diagonal braces may be planned according to the anticipated loads for the structure. For example, an anticipated standard load can be determined. If the load for a joint is expected to exceed the anticipated standard load, that joint may be braced as described above with a diagonal brace. In addition, if in constructing the cooling tower frame it is suspected or determined that a joint for some reason has improper moment strength, the joint may be reinforced by adding diagonal bracing to the column and beam. In either case, the joint may be reinforced by adding diagonal bracing to the affected column and beam so that moments may be transferred through the brace instead of or in addition to the joint. Bracing may be with a metal rod or with a fiber reinforced material diagonal member connected to adjacent columns in a similar manner as the beams are connected to the columns. Since such additional bracing is unlikely to be required in several contiguous locations, it is unlikely to substantially interfere with access to the interior of the tower or to substantially increase the cost of the tower. In addition, some design environments that are expected to be more rigorous may require that some supplemental diagonal bracing be provided in the upper levels of the cooling tower, but not to the extent that would be required without the moment-transferring joints of the present invention.

Another potential cost savings comes with material savings if cooling towers are hybrids, using some materials for some parts and other materials for other parts. Wood parts, of Douglas fir, redwood, or plywood, for example, are generally less expensive than fiber reinforced material parts, but may have disadvantages because of decay and because of chemical treatments leaching into the water distribution system. Under the present invention, it would be advantageous to make some parts out of wood and others out of fiber reinforced material. Generally, some parts of the cooling tower are more easily replaceable than others, and these more easily replaceable parts are generally those that are separable from the skeletal support frame 64 without disturbing the joints between the beams 68 and columns 66 and the columns 66 and base 46. These separable parts may include, where they are used, an access ladder 41 or stairway 43, a guard rail 40, the deck support lintels 82 and the deck planks 84. If the deck 84 is wood, wood roof lintels 82 are preferably used. Using wood for any one or more of these separable members should decrease the cost of constructing the deck. Replacement of any of these separable members would not require that the skeletal support frame be dismantled or destroyed.

Whether wood is used for the separable parts or not, the fill 78 and water distribution lintels 80 are preferably made of fiber reinforced material. If a fiber reinforced material is used for the deck 84, the underlying lintels or joists 82 will preferably also be made of fiber reinforced material.

In constructing a cooling tower having a frame such as illustrated in FIGS. 3–5 and 21, only a minimum number of different parts is necessary. For example, the columns may all be uniform 5 by 5 inch square tubular columns. They may, for example, be over twenty-six feet long to create a cooling tower with a twelve foot air intake level 44 and a fourteen foot upper level 42. In some installations, the vertical columns may be longer or shorter than twenty-six feet, with air intake levels higher or lower than twelve feet and plenum heights greater or less than fourteen feet in height; additional horizontal members may be used where the air intake level is higher than twelve feet. A footing or pedestal may be provided for each column. Standard beams, for example, all 10 inch beams, can be supplied, or groups of beams of different thicknesses could be provided, with various types of mounting brackets as illustrated in FIGS. 14–17, along with lightweight lintels 76, 78, 80 for the deck, fill material and water distribution system. Enough diagonal braces for bracing the air intake level 44 can be provided. Assuming that standard cell sizes are produced, a standardized fan 34 and fan shroud 36 can be supplied with the kit. With standardization of the cell size, the deck planking 38 can also be supplied in standard sizes, with a thickness of about 1 inch, for example, whether made of wood or fiber reinforced material. Using such standard components should not only reduce construction time but should also reduce errors. In addition, with such standard members, and with fewer varieties of standard members, pre-construction layout of the parts is simplified. No splicing of parts is required. No brackets are needed for the lintels in the fill and water distribution levels.

In the method of the present invention, a plurality of columns, a base and a plurality of beams are provided. Mounting plates with mounting surfaces are also provided. A pair of columns are aligned vertically on the base and the bottom ends are secured to the base. The mounting surfaces of the mounting plates are bonded to the planar surface at one end of a beam and to the planar surface on the vertical column to form a moment-transferring joint between the beam and the vertical column. The order of installation may be adjusted: it may be desirable to bond one or more beams to a pair of vertical columns and then secure the vertical columns to the base. The bonding step may be accomplished by applying the bonding material to one or both of the surfaces to be bonded, pressing the surfaces together and allowing the bonding material to cure. In pressing the surfaces together, screws may be inserted through holes in the mounting plate and into the beams and columns to position the parts until bonding occurs. Bolts may also be used to position the parts. Before placing the bonding material on the columns, beams and mounting plate, surface preparation may be desired: to improve the bond, the surfaces may be rough sanded and de-greased, although such surface preparation may not be necessary. After the appropriate cure time has passed, the joints may be observed to ensure proper application and curing. If the anticipated load is greater than the standard load for the joints, or if it is suspected that a joint has improper moment strength, the joints may be reinforced with diagonal bracing as described. The remainder of the cooling tower may then be constructed as has been done previously in the art.

Using the present invention, construction is expected to be quicker and cheaper, with less coordination required. Construction is less affected when building takes place out of sequence; the design can accommodate minor delivery problems without impact on progress. Compared to traditional wood structures, there are substantially fewer types of joints as well as substantially fewer joints, parts, types of parts, members and types of members.

While only specific embodiments of the invention have been described, it is apparent that various additions and modifications can be made thereto, and various alternatives can be selected. It is, therefore, the intention in the appended claims to cover all such additions, modifications and alternatives as may fall within the true scope of the invention.

We claim:

1. A cooling tower comprising:

a skeletal support frame defining an interior volume and including:

a plurality of vertical columns made of a material containing reinforcing fibers, said vertical columns having bottom ends;

a plurality of beams made of a material containing reinforcing fibers, each beam being connected at its ends to a pair of said vertical columns;

a fluid distribution system to distribute fluid within said interior volume defined by said skeletal support frame;

heat exchange material within said interior volume defined by said skeletal support frame for receiving fluid from said fluid distribution system and through which said fluid may travel;

a base for collecting cooled fluid from said heat exchange material and having a flat bottom surface and additional surfaces for retaining the collected cooled fluid;

footings having horizontal and vertical surfaces, the horizontal surfaces overlying the flat bottom surface of the base and each vertical surfaces juxtaposed with a vertical surface of one column above the flat bottom surface of the base; and bonding material disposed between the horizontal surfaces of the footings and the flat bottom surface of the base and between the vertical surface of each footing and the vertical surface of one column above the flat bottom surface of the base to bond each footing to the flat bottom surface of the base and to a vertical surface of one column.

2. A cooling tower comprising:

first and second vertical columns, each column made of a material containing reinforcing fibers and having top and bottom ends;

a first level beam made of a material containing reinforcing fibers, said first level beam extending between said first and second columns at a first vertical level between the top and bottom ends of the vertical columns and having a first end at said first column and a second end at said second column;

a second level beam made of a material containing reinforcing fibers, said second level beam extending between said first and second columns at a second vertical level and having a first end at said first column and a second end at said second column;

said vertical columns and said first level beam having mounting surfaces at the junctions of said first level beam and said vertical columns;

said vertical columns and said second level beam having mounting surfaces at the junctions of said second level beam and said vertical columns;

a fluid distribution system for distributing fluid within said cooling tower, said fluid distributing system being at one vertical level;

heat exchange material through which fluid from said fluid distribution system may pass, said heat exchange material being at another vertical level;

a first level mounting member at the junction of said first vertical column and said first end of said first level beam and a first level mounting member at the junction of said second vertical column and said second end of said first level beam, each first level mounting member having a mounting surface bonded to said mounting surfaces of said first level beam and said first and second vertical columns to define moment-transferring joints at said junctions;

a second level mounting member at the junction of said first vertical column and said first end of said second level beam and a second level mounting member at the junction of said second column and said second end of said second level beam, each second level mounting member having a mounting surface bonded to said mounting surfaces of said second level beam and said first and second vertical columns to define moment-transferring joints at said junctions;

wherein said first level mounting members and second level mounting members are free from any connection to a diagonal cross-brace which extends above the first level beams.

3. The cooling tower of claim 2 wherein the tower is a counterflow cooling tower having an air intake level below the first level horizontal beams and wherein the heat transfer material is between the first and second level horizontal beams and the fluid distribution system is above the second level horizontal beams.

4. The cooling tower of claim 3 wherein at least one of the mounting members is selected from the group consisting of plates including fiber reinforced material having a thickness greater than one-eighth inch and plates including a metal.

5. The cooling tower of claim 3 further including mechanical fasteners extending between the mounting members and the columns and mechanical fasteners extending between the mounting members and the beams.

6. The cooling tower of claim 5 further comprising a third vertical column, a perpendicular beam extending between the first column and third column, and a perpendicular mounting member bonded to said first column and said perpendicular beam, said perpendicular beam being normal to said first level beam and said perpendicular mounting member being normal to the first level mounting member bonded to said first vertical column and free from any connection to a diagonal cross-brace that would extend above the first level beam, the cooling tower further including mechanical fasteners extending between the perpendicular mounting member and the first vertical column and mechanical fasteners extending between the perpendicular mounting member and the perpendicular beam.

7. A method of constructing a cooling tower comprising the steps of:

providing a plurality of columns, each column being made of a fiber reinforced material and having a bottom end, a top end, a first mounting surface between the top and bottom ends and a second mounting surface between the top and bottom ends, the first and second mounting surfaces lying in intersecting planes;

providing a plurality of beams, each beam being made of a fiber reinforced material and having a first end and a second end, a first mounting surface at the first end and a second mounting surface at the second end;

providing a plurality of mounting members having mounting surfaces;

providing a bonding material that is applied in an uncured state and that cures to another state;

providing a plurality of mechanical fasteners;

providing a base;

aligning a first and second column on said base and securing said bottom ends of said columns to said base, with the first mounting surfaces of the first and second columns lying in a vertical plane;

placing a first beam between said first and second columns with the first mounting surface of the first beam adjoining the first mounting surface of the first column and the second mounting surface of the beam adjoining the first mounting surface of the second column;

placing a first mounting member at the mounting surfaces of the first end of the first beam and the first mounting surface of the first column with uncured bonding material between the first mounting surface of the first beam and the mounting surface of the first mounting member and uncured bonding material between the first mounting surface of the first column and the mounting surface of the first mounting member;

placing mechanical fasteners to connect the first mounting member and the first column and the first mounting member and the first beam;

placing a second mounting member at the mounting surfaces of the second end of the first beam and the first mounting surface of the second column with uncured bonding material between the mounting surfaces of the second end of the first beam and the second mounting member and uncured bonding material between the mounting surfaces of the second column and the second mounting member;

placing mechanical fasteners to connect the second mounting member and the second column and the second mounting member and the first beam;

aligning a third column on said base and securing said bottom end of said third column to said base, with the first mounting surfaces of the third column and second mounting surface of the first column lying in a vertical plane intersecting the vertical plane of the first mounting surfaces of the first and second columns;

placing a second beam between said first and third columns with the first mounting surface of the second beam adjoining the second mounting surface of the first column and the second mounting surface of the second beam adjoining the first mounting surface of the third column;

placing a third mounting member at the mounting surfaces of the first end of the second beam and the second mounting surface of the first column with uncured bonding material between the first mounting surface of the second beam and the mounting surface of the third mounting member and uncured bonding material between the second mounting surface of the first column and the mounting surface of the third mounting member;

placing mechanical fasteners to connect the third mounting member and the first column and the third mounting member and the second beam;

placing a fourth mounting member at the mounting surfaces of the second end of the second beam and the first mounting surface of the third column with uncured bonding material between the second mounting surface of the second beam and the mounting surface of the fourth mounting member and uncured bonding material between the first mounting surface of the third column and the mounting surface of the fourth mounting member;

placing mechanical fasteners to connect the fourth mounting member and the third column and the fourth mounting member and the second beam;

wherein the mechanical fasteners are placed before the bonding material cures to the final cured state; and wherein the first and second beams are substantially horizontal and lie in intersecting vertical planes before the bonding material cures to the final cured state.

8. The method of claim 7 wherein the distance between the centerlines of the first and second columns is greater than four feet and the distance between the centerlines of the first and third columns is greater than four feet.

9. The cooling tower of claim 8 wherein the distance between the centerlines of the first and second columns is greater than six feet and the distance between the centerlines of the first and third columns is greater than six feet.

10. The cooling tower of claim 7 further comprising the steps of placing heat exchange material above the first and second beams and placing a fluid distribution system above the heat exchange material.

* * * * *